US009066407B2

(12) United States Patent
Terasaka et al.

(10) Patent No.: US 9,066,407 B2
(45) Date of Patent: Jun. 23, 2015

(54) POWER SOURCE UNIT FOR LED LAMPS, AND LED LAMP SYSTEM

(75) Inventors: Hiroshi Terasaka, Yokosuka (JP); Hiroshi Kubota, Yokosuka (JP); Masahiko Kamata, Yokosuka (JP); Naoko Iwai, Yokosuka (JP); Takeshi Saito, Ashiya (JP); Hiroki Nakagawa, Ibaraki (JP); Katsunobu Hamamoto, Neyagawa (JP); Hiroyuki Sako, Hirakata (JP)

(73) Assignees: Toshiba Lighting & Technology Corporation, Kanagawa (JP); Panasonic Corporation, Osaka (JP); Panasonic Electric Works Co., Ltd., Osaka (JP)

( * ) Notice: Subject to any disclaimer, the term of this patent is extended or adjusted under 35 U.S.C. 154(b) by 386 days.

(21) Appl. No.: 13/188,571

(22) Filed: Jul. 22, 2011

(65) Prior Publication Data

US 2012/0019166 A1 Jan. 26, 2012

(30) Foreign Application Priority Data

Jul. 26, 2010 (JP) ..... 2010-167191

(51) Int. Cl.
*H05B 37/02* (2006.01)
*H05B 33/08* (2006.01)

(52) U.S. Cl.
CPC ..... *H05B 33/089* (2013.01)

(58) Field of Classification Search
CPC ..... H05B 33/0833; H05B 33/0842; H05B 33/0875; H05B 33/089; H05B 33/0803; H05B 33/0815; Y02B 29/341; Y02B 20/342
USPC ..... 315/291, 294, 306–308, 312, 224, 247; 362/800, 311.02
See application file for complete search history.

(56) References Cited

U.S. PATENT DOCUMENTS

| | | | | |
|---|---|---|---|---|
| 6,160,361 | A | 12/2000 | Giannopoulos | |
| 6,337,544 | B1 | 1/2002 | Wang | |
| 7,344,284 | B2 * | 3/2008 | Lynam et al. | 362/345 |
| 7,507,001 | B2 * | 3/2009 | Kit | 362/276 |

(Continued)

FOREIGN PATENT DOCUMENTS

| | | |
|---|---|---|
| CN | 1274515 | 11/2000 |
| CN | 1340285 | 3/2002 |

(Continued)

OTHER PUBLICATIONS

Chinese office Action issued in CN 201110221446.3 on Jul. 15, 2013.

(Continued)

*Primary Examiner* — Haiss Philogene
(74) *Attorney, Agent, or Firm* — DLA Piper LLP (US)

(57) ABSTRACT

A dedicated power source for LED lamps capable of reliably detecting attachment of an LED lamp is provided.
A dedicated power source has a DC power source portion, and includes a lighting circuit which receives power supplied from the DC power source portion and light-controls an LED lamp including an LED element and a detection resistor connected in parallel to the LED element and an attachment detecting portion for detecting attachment of the LED lamp based on a voltage level changing in accordance with attachment/detachment of the detection resistor by attachment/detachment of the LED lamp.

12 Claims, 3 Drawing Sheets

(56) References Cited

U.S. PATENT DOCUMENTS

| | | | | |
|---|---|---|---|---|
| 7,553,051 | B2 * | 6/2009 | Brass et al. | 362/373 |
| 7,589,472 | B2 | 9/2009 | Keith | |
| 7,825,612 | B2 * | 11/2010 | Lee | 315/308 |
| 8,198,831 | B2 * | 6/2012 | Matsuoka et al. | 315/307 |
| 8,310,169 | B2 * | 11/2012 | Yu | 315/246 |
| 8,324,838 | B2 * | 12/2012 | Shah et al. | 315/307 |
| 8,575,857 | B2 * | 11/2013 | Sako et al. | 315/291 |
| 8,710,750 | B2 * | 4/2014 | Nonaka et al. | 315/185 S |
| 2007/0188114 | A1 | 8/2007 | Lys et al. | |
| 2008/0218171 | A1 | 9/2008 | Keith | |
| 2008/0284346 | A1 | 11/2008 | Lee | |
| 2010/0181919 | A1 | 7/2010 | Slaon | |
| 2011/0043134 | A1 | 2/2011 | Lee | |
| 2012/0286668 | A1 | 11/2012 | Kondo et al. | |

FOREIGN PATENT DOCUMENTS

| | | |
|---|---|---|
| CN | 1902988 | 1/2007 |
| CN | 101668375 | 3/2010 |
| JP | 2004-158840 | 6/2004 |
| JP | 2007-044073 | 2/2007 |
| JP | 2009-158111 | 7/2009 |
| KR | 10-2004-0061560 | 7/2004 |
| WO | WO2009/146934 | 12/2009 |
| WO | WO 2011/077987 | 6/2011 |

OTHER PUBLICATIONS

English Language Translation of Chinese office Action issued in CN 201110221446.3 on Jul. 15, 2013.
English Language Abstract of CN 101668375 published on Mar. 10, 2010.
English Language Abstract of CN 1274515 published on Nov. 22, 2000.
English Language Abstract of CN 1340285 published on Mar. 13, 2002.
English Language Abstract of CN 1902988 published on Jan. 24, 2007.
Extended European Search Report issued in EP 11175240.8 on May 24, 2013.
English Language Astract of JP 2009-158111 published on Jul. 16, 2009.
English Language Translation of JP 2009-158111 published on Jul. 16, 2009.
Office Action issued in Korean Application 10-2011-0072907 on Jan. 24, 2013.
English Language Translation of Office Action issued in Korean Application 10-2011-0072907 on Jan. 24, 2013.
English Language Abstract of JP 2004-158840 published Jun. 3, 2004.
English Language Translation of JP 2004-158840 published Jun. 3, 2004.
English Language Abstract of KR 10-2004-0061560 published Jul. 7, 2004.
European Office Action issued in EP 11175240.8 on Jan. 9, 2014.
Chinese Office Action issued in CN 201110221446.3 on Jan. 3, 2014.
English Language Translation of Chinese Office Action issued in CN 201110221446.3 on Jan. 3, 2014.
Japanese Patent Office Action issued in JP 2010-167191 dated Feb. 19, 2014.
English Language Translation of Japanese Patent Office Action issued in JP 2010-167191 dated Feb. 19, 2014.
English Language Abstract and Translation of JP 2007-044073 published Feb. 11, 2007.
European Office Action issued in EP 11175240.8 dated Apr. 10, 2015.

* cited by examiner

POWER SOURCE UNIT FOR LED LAMPS, AND LED LAMP SYSTEM

INCORPORATION BY REFERENCE

The present invention claims priority under 35 U.S.C. §119 to Japanese Patent Application No. 2010-167191 filed on Jul. 26, 2010. The content of the application is incorporated herein by reference in their entirety.

FIELD OF THE INVENTION

The present invention relates to a power source unit for LED lamps which supplies power to an LED lamp having an LED element, and an LED lamp system including the power source unit.

BACKGROUND OF THE INVENTION

A lamp device using an LED element having low power consumption and a long life has been generally proposed as a light source usable in place of, for example, a straight-tube type or self-ballasted fluorescent lamp. As disclosed in, for example, Japanese Laid-Open Patent Publication No. 2009-158111, such a lamp device has a DC power source portion and a lighting circuit for lighting an LED lamp including the LED element with use of power supplied from the DC power source portion.

For an LED lamp system, in terms of convenience and saving-energy, it is not preferable that the lighting circuit operates with the LED lamp not attached to the lighting circuit, so it is preferable to be able to detect attachment of the LED lamp.

However, although, in the case of, for example, a lamp device using a fluorescent lamp, attachment of the fluorescent lamp can be detected based on voltage division with use of a resistance value of a filament, such as an attachment detection with use of a resistance value is impossible in the case of an LED lamp having no filament. Accordingly, in an LED lamp system using an LED lamp, it has been demanded that attachment of the LED lamp can be detected.

In view of the above problem, the present invention has been made and aims to provide a power source unit for LED lamps which can reliably detect attachment of an LED lamp, and an LED lamp system including the power source unit.

SUMMARY OF THE INVENTION

A power source unit for LED lamps of the present invention has: a DC power source portion; a lighting circuit which receives power from the DC power source portion and light-controls an LED lamp including an LED element and a detection resistor connected in parallel to the LED element; and an attachment detecting portion for detecting attachment of the LED lamp based on a voltage level changing in accordance with attachment/detachment of the detection resistor by attachment/detachment of the LED lamp. Based on the voltage level changing in accordance with attachment of the detection resistor by attachment/detachment of the LED lamp, attachment/detachment of the LED lamp can be reliably detected.

DETAILED DESCRIPTION OF THE PREFERRED EMBODIMENTS

Figure 1:
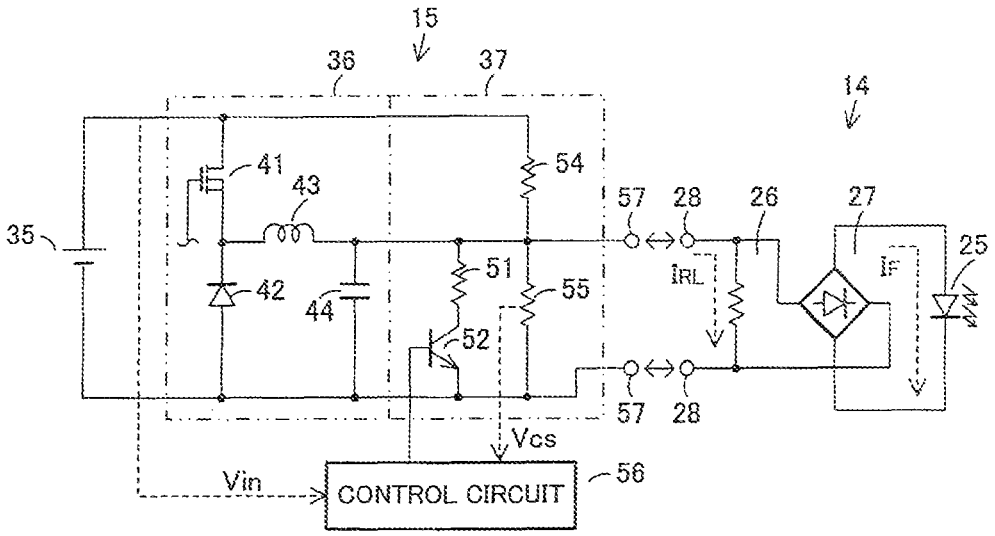
FIG. 1 is a circuit diagram of a power source unit for LED lamps according to a first embodiment.

A first embodiment will be described below with reference to FIGS. 1 and 2.

Figure 2:
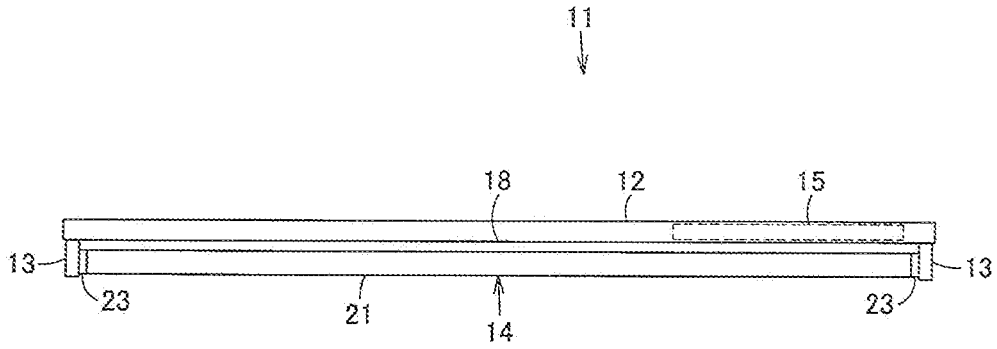
FIG. 2 is a side view of an LED lamp system including the power source unit for LED lamps.

In FIG. 2, the reference numeral 11 denotes an LED lamp system, and the LED lamp system 11 corresponds to, for example, a system for a single straight-tube type fluorescent lamp, and includes: a long fixture body 12 as a system body; a pair (one and the other) of sockets 13 as a light source attaching unit disposed at both ends of the fixture body 12 so as to face each other; an (straight-tube type) LED lamp 14 as a straight-tube type light source or a lamp connected between the pair of sockets 13; and a dedicated power source 15 which is a lighting device as a power source unit for LED lamps which is disposed in the fixture body 12 and supplies power to and lights the LED lamp 14.

The LED lamp system 11 of the embodiment is a renewal system that uses the fixture body 12 of the existing lighting fixture using a tube type fluorescent lamp as it is and using an LED lamp 14 and dedicated power source 15. Alternatively, in the case where the LED lamp system 11 using the LED lamp 14 and the dedicated power source 15 is newly installed, it is installed as the LED lamp system 11 reusing the fixture body 12 of the existing lighting fixture structure using a straight-tube type fluorescent lamp and a socket 13 dedicated for the LED lamp system 11 and using the LED lamp 14 and dedicated power source 15. There is an LED lamp system 11 (LED lamp 14) of, for example, 40 W specification or 20 W specification. In the embodiment, in accordance with the LED lamp system 11 (LED lamp 14), in the case of 40 W specification, the dedicated power source 15 outputs a voltage of 98V, and in the case of 20 W specification, the dedicated power source 15 outputs a voltage of 45V.

The fixture body 12 includes a body portion (not shown) mounted on a ceiling or the like as an installation face, and a reflector 18 which is detachably attached to and covers the body portion, and has an inverted triangular shape.

The sockets 13 are attached to both ends of the body portion of the fixture body 12, and project to an outer face of the reflector 18 through socket insertion holes formed at both ends of the reflector 18. The dedicated power source 15 is connected to a terminal built in one of the sockets 13, and the other socket 13 can be properly used for only holding the LED lamp 14, securing earth connection of the LED lamp 14 or the like.

The LED lamp 14 includes, for example, a cylindrical straight tube body 21 having transmittance, a light emitting module (not shown) housed in the tube body 21 and connection portions 23 provided at both ends of the tube body 21.

The tube body 21 is made of glass or resin having transmittance and diffuseness, and formed in a long cylindrical shape having substantially the same tube length, tube diameter and appearance as those of a straight-tube type fluorescent lamp. The connection portions 23 as an attachment portion are provided at both ends of the tube body 21.

The light emitting module includes: a slender substrate (not shown) arranged along a tube axial direction of the tube body 21; an LED element 25 as a load mounted along a longitudinal direction of the substrate; a detection resistor 26 connected in parallel to the LED element 25; and a rectifying element 27. Light may be emitted mainly from a predetermined direction of the tube body 21 by making the substrate of the light emitting module flat and mounting the LED element 25 on one face of the flat substrate. Alternatively, light may be emitted from the whole circumference of the tube body 21 by forming the substrate in a polygonal cylindrical shape and mounting the LED element 25 on the periphery of the polygonal cylindrical-shaped substrate. In the LED element 25, an LED chip emitting blue light is sealed with transparent resin containing fluorescent matter which is excited by blue light to emit yellow light, and white light is emitted from a surface of the transparent resin. Moreover, although only one LED element 25 is shown in FIG. 1, the plurality of LED elements 25 may be connected in series to each other. In this case, the detection resistor 26 is connected in parallel to the series circuit of the LED elements 25.

A resistance value $R_L$ of the detection resistor 26 can be arbitrarily set, however, for example, it is set considering that the value is sufficiently larger than a load impedance (equivalent resistance value) Z of the LED element 25, consumption power is sufficiently small and dimming performance of the LED element 25 (LED lamp 14) is excellent. When the resistance value $R_L$ of the detection resistor 26 is relatively smaller than the load impedance Z of the LED element 25, a difference between a value $I_F$ of current flowing through the LED element 25 and a value $I_{RL}$ of current flowing through the detection resistor 26 becomes relatively small, the value $I_F$ of current flowing through the LED element 25 is not easily detected from the current value ($I_F$+$I_{RL}$) of the whole LED lamp 14, and the dimming performance is lowered. Accordingly, it is preferable that the resistance value $R_L$ is sufficiently large and, for example, four or more times the load impedance Z of the LED element 25 at a dimming lower limit.

Specifically, when a rated current value in a full-lighting state (100% dimming state) is set to 350 mA (0.35 A) and a dimming lower limit is set to, for example, 0.5%, the value $I_F$ of current flowing through the LED element 25 is 350×0.005=1.75 mA (0.00175 A). In the case of 40 W specification, for example, the load impedance Z of the LED element 25 at the dimming lower limit is 100/0.00175≈57.1 kΩ, and in the case of 20 W specification, the load impedance Z of the LED element 25 at the dimming lower limit is 50/0.00175≈28.6 kΩ. Preferably, the resistance value $R_L$ of the detection resistor 26 is set to four or more times the load impedance Z.

On the other hand, when the resistance value $R_L$ of the detection resistor 26 is set too large, the value $I_F$ of current flowing through the LED element 25 in deep dimming becomes too small and energy for lighting the LED 25 becomes insufficient. Accordingly, preferably, the resistance value $R_L$ of the detection resistor 26 is set to, for example, six or less times the load impedance Z of the LED element 25 at the dimming lower limit.

Accordingly, the resistance value $R_L$ of the detection resistor 26 is preferably set to four to six times, more preferably, five times the load impedance Z of the LED element 25 at the dimming lower limit. For example, in the case of LED lamp 14 of 40 W specification, the resistance value $R_L$ of the detection resistor 26 is preferably not smaller than 270 kΩ (about 4.73 times the load impedance Z at the dimming lower limit) and not larger than 330 kΩ (about 5.78 times the load impedance Z at the dimming lower limit). In the case of LED lamp 14 of 20 W specification, the resistance value $R_L$ of the detection resistor 26 is preferably not smaller than 130 kΩ (4.55 times the load impedance Z at the dimming lower limit) and not larger than 170 kΩ (5.95 times the load impedance Z at the dimming lower limit).

Further, since the resistance value of the detection resistor 26 is preferably set by connecting a plurality of resistors in series to each other, in the case of 40 W specification, it is most preferable to set the resistance value to, for example, 300 kΩ, and in the case of 20 W specification, it is most preferable to set the resistance value to, for example, 150 kΩ.

A load factor of the detection resistor 26 with a voltage of 120V applied is preferably set to 0.4 (40%) or smaller. Accordingly, in the case of 40 W specification, the rated capacity of the detection resistor 26 having a resistance value $R_L$ of 300 kΩ is set to 120×120/300 kΩ/0.4)=0.12 W or larger, and in the case of 20 W specification, the rated capacity of the detection resistor 26 having a resistance value $R_L$ of 150 kΩ is set to 120×120/150 kΩ/0.4≈0.24 W or larger.

The rectifying element 27 rectifies current flowing to the LED element 25 and is a full-wave rectifying element such as a bridge diode. In the embodiment, with respect to the LED element 25, the rectifying element 27 is arranged at a downstream side of the detection resistor 26. That is, the detection resistor 26 is arranged at the upstream side of the rectifying element 27.

The connection portion 23 shown in FIG. 2 is connected to the socket 13 made of, for example, synthetic resin having insulating performance and in the same shape as that of a cap of a straight-tube type fluorescent lamp, and attached and fixed to the end of the tube body 21. A pair of lamp pins 28 (see FIG. 1) as a power receiving portion similar to the lamp pins of a straight-tube type fluorescent lamp is provided in a projecting manner on an end face of the connection portion 23. Moreover, the connection portion 23 is not limited to being constituted by the pair of lamp pins 28, and may be constituted by a single lamp pin or the like. Any constitution is applicable to the connection portion 23 as long as it can realize electric connection or support of the connect ion portion 23 to the socket 13. Additionally, the connection portion 23 may be electrically and physically connected to the socket 13 via, for example, an adaptor.

The LED lamp 14 has substantially the same outer diameter and total luminous flux as those of, for example, an existing straight-tube type fluorescent lamp.

The dedicated power source 15 has a DC power source portion 35 for outputting DC voltage, a lighting circuit 36 electrically connected to the DC power source portion 35 and an attachment detecting portion 37 to which the LED lamp 14 can be electrically and mechanically connected.

The DC power source portion 35 includes, for example, a full-wave rectifying element such as a bridge diode for rectifying AC power from a commercial AC power source, a smoothing element such as a smoothing capacitor for smoothing output power from the full-wave rectifying element and a power factor correction (PFC) circuit including a chopper circuit for converting voltage to a predetermined voltage, etc., converts AC power having an AC sine wave or AC rectangular wave to DC power and supplies the DC power to the lamp pins 28 of the LED lamp 14 through the socket 13. Moreover, the DC power source portion 35 may be connected to an output side of an AC power source such as a fluorescent lamp lighting device for outputting AC power as AC power from a commercial AC power source.

The lighting circuit 36 includes: a series circuit of a lighting switching element 41 and a diode 42, the series circuit being electrically connected between both ends of the DC power source portion 35; an inductor 43 electrically connected to a connection point between the lighting switching element 41 and the diode 42; and a smoothing capacitor 44 which is electrically connected to the inductor 43 and smoothes output current. The lighting circuit 36 is, for example, a diode rectification type step-down DC-DC converter which steps down output voltage $V_{in}$ of the DC power source portion 35 of approximately 141 to 415V to approximately 45 to 100V.

The lighting switching element 41 is, for example, a field effect transistor (FET) and performs switching at a high potential side (high side) of the DC power source portion 35. A gate terminal which is a control terminal of the lighting switching element 41 is constituted so that it is electrically connected to a switching control unit (high side driver, not shown), and the lighting switching element 41 is turned on/off at high speed by a signal transmitted from the switching control unit.

An anode of the diode 42 is grounded, and a cathode thereof is electrically connected to the lighting switching element 41. That is, the diode 42 constitutes a closed circuit with the inductor 43, the smoothing capacitor 44 and the LED lamp 14 when the lighting switching element 41 is off.

The attachment detecting portion 37 includes: a series circuit of a protection resistor 51 and a protection switching element 52, the series circuit being electrically connected in parallel to the smoothing capacitor 44 with respect to an output side of the lighting circuit 36 or the inductor 43; a series circuit of a first voltage dividing resistor 54 and a second voltage dividing resistor 55 as a dividing resistor electrically connected in parallel to the lighting circuit 36 between both ends of the DC power source portion 35; and a control circuit 56 having a detecting unit and a controlling unit which are electrically connected to these series circuits. The attachment detecting portion 37 is electrically connected to connection pins 57 as connection receiving portions connected to the lamp pins 28, and is electrically connectable to the LED lamp 14 via the connection pins 57.

The protection resistor 51 is connected in parallel to the smoothing capacitor 44 with respect to the inductor 43, and has a resistance value sufficiently smaller than those of the voltage dividing resistors 54 and 55.

The protection switching element 52 is, for example, an NPN type bipolar transistor, a base terminal, which is a control terminal, of the element 52 is electrically connected to the control circuit 56, a collector terminal thereof is electrically connected to the protection resistor 51, and an emitter terminal thereof is grounded.

The first voltage dividing resistor 54 is electrically connected in parallel to the lighting switching element 41 with respect to the DC power source portion 35. The first voltage dividing resistor 54 has a resistance value of, for example, about 2MΩ (2040 kΩ).

The second voltage dividing resistor 55 is electrically connected in parallel to the smoothing capacitor 44 at an output side of the inductor 43 and electrically connected in parallel between the connection pins 57, 57. That is, the second voltage dividing resistor 55 is connected to the connection pins 57, 57 so as to be parallel to the LED lamp 14.

A resistance value $R_{CS}$ of the second voltage dividing resistor 55 can be arbitrarily set. As the resistance value $R_{CS}$ of the second voltage dividing resistor 55 is larger, a voltage division level of DC voltage, which is divided by the voltage dividing resistors 54 and 55, by the second voltage dividing resistor 55 of the DC power source portion 35 or a DC voltage level $V_{CS}$ is larger, and attachment of the LED lamp 14 is more easily detected. However, when the resistance value $R_{CS}$ of the second voltage dividing resistor 55 is too large, the DC voltage level $V_{CS}$ when the DC type LED lamp 14 is not attached, that is, voltage between the connection pins 57, 57, is unfavorably too large. On the other hand, when the resistance value $R_{CS}$ is too small, there is a possibility that the DC voltage levels $V_{CS}$ in the case where the LED lamp 14 is attached when the maximum output voltage $V_{in}$ (for example, 415V) from the DC power source portion 35 and in the case where the LED lamp 14 is detached (not attached) when the minimum output voltage $V_{in}$ (for example, 141V) are inversed and attachment/non-attachment is erroneously detected.

Accordingly, in the embodiment, the resistance value $R_{CS}$ of the second voltage dividing resistor 55 is set in a range that the above inversion is not caused and the DC voltage level $V_{CS}$ is not too large, to, for example, not less than 700 kΩ and not more than 1 MΩ.

The control circuit 56 is, for example, a microcomputer and can detect the output voltage $V_{in}$ of the DC power source portion 35 and the DC voltage level $V_{CS}$. The control circuit 56 includes a memory as a storing unit therein and stores a threshold voltage $V_{th}$ to be compared with the DC voltage level $V_{CS}$.

When the LED lamp system 11 is activated, the control circuit 56 detects the DC voltage level $V_{CS}$ and compares the DC voltage level $V_{CS}$ with the preset threshold voltage $V_{th}$. The threshold voltage $V_{th}$ is adjusted by the control circuit 56 in accordance with the size of the output voltage $V_{in}$ from the DC power source portion 35, and is set relatively large when the output voltage $V_{in}$ is relatively large.

When it is judged that the DC voltage level $V_{CS}$ is larger than the threshold voltage $V_{th}$, the control circuit 56 judges that the LED lamp 14 is not connected between the connection pins 57, 57, and stops the switching control unit switching the lighting switching element 41, etc., to immediately stop driving of the DC power, source portion 35 and the lighting circuit 36.

On the other hand, when it is judged that the DC voltage level $V_{CS}$ is not larger than the threshold voltage $V_{th}$, the control circuit 56 judges that the LED lamp 14 is connected between the connection pins 57, 57, drives the DC power source portion 35 and the lighting circuit 36 such as switching the lighting switching element 41 by the switching control unit and controls a value of current which flows to the LED lamp 14 by the lighting circuit 36, if necessary, to light-control (dim) the LED lamp 14.

Moreover, when the DC voltage level $V_{CS}$ is larger than a predetermined voltage, for example, 45V, the control circuit 56 turns on the protection switching element 52, keeps the DC voltage level $V_{CS}$ 45V or smaller and thus prevents a voltage larger than 45V from being output between the connection pins 57, 57.

In the first embodiment, since the LED element 25 thus has no filament, the LED lamp 14 including the detection resistor 26 connected in parallel to the LED element 25 is used to constitute the attachment detecting portion 37 of the dedicated power source 15 so that a voltage level which is a DC voltage level $V_{cs}$ herein to be detected in accordance with attachment/detachment of detection resistor 26 by attachment/detachment of the LED lamp 14 changes. Specifically, the attachment detecting portion 37 is constituted so that the LED element 25 and the detect ion resistor 26 are connected in parallel to the second voltage dividing resistor 55 of the dividing resistors 54 and 55 by attachment of the LED lamp 14. Thus, when the LED lamp 14 is not connected between the connection pins 57, 57, voltage division is performed only by the voltage dividing resistors 54 and 55, and when the LED lamp 14 is connected between the connection pins 57, 57, voltage division is performed by parallel connection resistances between the first voltage dividing resistor 54 and the second voltage dividing resistor 55 with the detection resistor 26 and thus the DC voltage level $V_{CS}$ is lowered. Accordingly, by comparing the DC voltage level $V_{CS}$ obtained by dividing a DC voltage from the DC current portion 35 by the second voltage dividing resistor 55 with a predetermined threshold voltage $V_{th}$ to detect attachment of the LED lamp 14, attachment of the LED lamp 14 can be reliably detected.

Since the LED lamp system 11 includes the dedicated power source 15, attachment of the LED lamp 14 can be detected. Therefore, for example, when the LED lamp 14 is not attached, improvement in convenience, saving-energy and improvement in safety can be realized by halting the lighting circuit 36, or the like.

By setting the resistance value $R_L$ of the detection resistor 26 to four or more times the load impedance Z of the LED element 25 at the dimming lower limit, the value $I_{RL}$ of current flowing through the detection resistor 26 becomes sufficiently smaller than the value $I_F$ of current flowing through the LED element 25, and the dimming performance of the LED element 25 (LED lamp 14) can be secured. By setting the resistance value $R_L$ of the detection resistor 26 to six or less times the load impedance Z of the LED element 25 at the dimming lower limit, the value $I_F$ of current flowing through the LED element 25 can be secured. Thus, even in the case where, for example, damage is caused to the connection pins 57, 57 and the lamp pins 28, 28 when the LED lamp 14 (LED element 25) is deeply dimmed, the LED element 25 (LED lamp 14) can be reliably lit.

Specifically, in the case where the rated current value in the full-lighting state of the LED element 25 is 350 mA and the dimming lower limit of the LED element 25 is 0.5% of the full-lighting state, for the LED lamp 14 (LED lamp system 11) of 40 W specification, by setting the resistance value $R_L$, of the detection resistor 26 of the LED lamp 14 to not less than 270 and not more than 330 kΩ, further preferably, 300 kΩ, the dimming performance of the LED element 25 (LED lamp 14) can be reliably secured, and the LED element 25 (LED lamp 14) can be reliably lit even in deep dimming.

For the LED lamp 14 (LED lamp system 11) of 20 W specification, by setting the resistance value $R_L$ of the detection resistor 26 of the LED lamp 14 to not less than 130 and not more than 170 kΩ, preferably, 150 kΩ, the dimming performance of the LED element 25 (LED lamp 14) can be reliably secured and the LED element 25 (LED lamp 14) can be reliably lit even in deep dimming.

The attachment detecting portion 37 can vary the threshold voltage $V_{th}$ or an attachment detection level of the LED lamp 14, in accordance with the input voltage $V_{in}$ from the DC power source portion 35 to the lighting circuit 36, and thus precision of attachment detection of the LED lamp 14 can be further improved.

Since, in the LED lamp 14, the detection resistor $R_L$ is connected at an upstream side (high potential side) of the rectifying element 27, attachment of the LED lamp 14 can be detected and precision of attachment detection of the LED lamp 14 can be further improved regardless of step-down (for example, approximately 0.6V) and unevenness of the voltage caused in the rectifying element 27.

Figure 3:
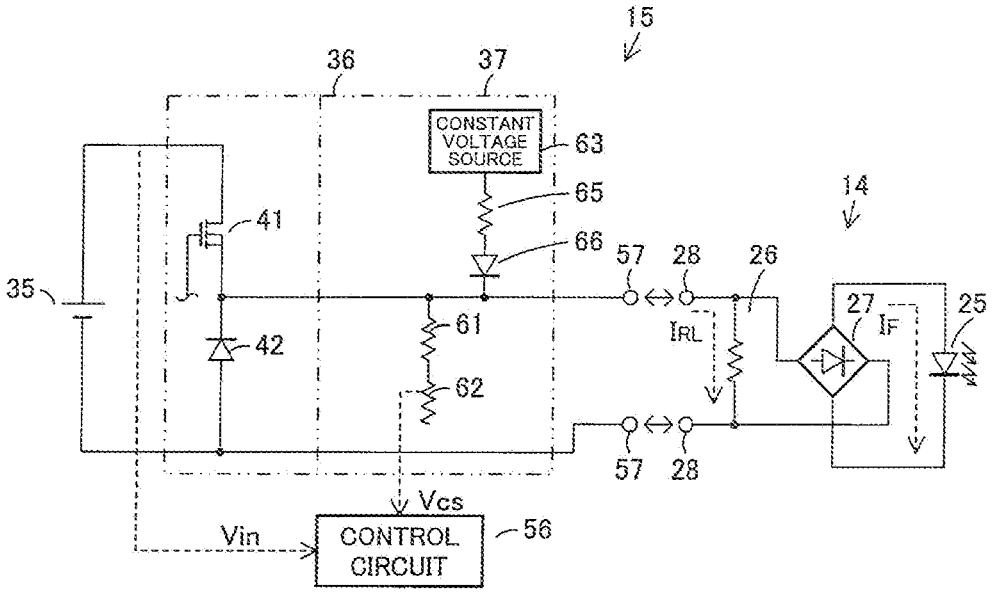
FIG. 3 is a circuit diagram of a power source unit for LED lamps according to a second embodiment.

Next, a second embodiment will be described with reference to FIG. 3. Moreover, the same symbols are attached to the same components and operations as those of the first embodiment, and description thereof will be omitted.

In the second embodiment, the attachment detecting portion 37 of the first embodiment has a first voltage dividing resistor 61 as a resistor for voltage division, a second voltage dividing resistor 62 as a resistor for voltage division and a constant voltage source 63.

The voltage dividing resistors 61 and 62 are electrically connected in series to each other, and electrically connected to the connection point between the lighting switching element 41 and the diode 42. The series circuit of the voltage dividing resistors 61 and 62 is connected between the connection pins 57, 57. Accordingly, in a state where the LED lamp 14 is connected between the connection pins 57, 57, the LED element 25 and the detection resistor 26 are connected in parallel to the voltage dividing resistors 61 and 62. Moreover, resistance values of the voltage dividing resistors 61 and 62 are properly set so that, particularly, the DC voltage level $V_{CS}$, which is a voltage division level of the second voltage dividing resistor 62 can be detected.

The constant voltage source 63 is connected to the connection point between the lighting switching element 41 and the diode 42 via a series circuit of a resistor 65 and a diode 66 electrically in parallel with the series circuit of the voltage dividing resistors 61 and 62 so that a preset DC constant voltage between the connection pins 57, 57 can be applied.

The control circuit 56 detects the DC voltage level $V_{CS}$ of the second voltage dividing resistor 62 with respect to DC constant voltage from the constant voltage source 63 divided by the voltage dividing resistors 61 and 62. When the DC voltage level $V_{CS}$ is larger than the threshold voltage $V_{th}$, the control circuit 56 judges the LED lamp 14 is not connected between the connection pins 57, 57, and stops the lighting switching element 41 switching by the switching control unit, etc., to immediately stop driving of the DC power source portion 35 and the lighting circuit 36.

On the other hand, if it is judged that the DC voltage level $V_{CS}$ is not larger than the threshold voltage $V_{th}$, the control circuit 56 judges that the LED lamp 14 is connected between the connection pins 57, 57, makes the switching control unit switch the lighting switching element 41, drives the DC power source portion 35 and the lighting circuit 36, and controls a value of current which flows to the LED lamp 14 by the lighting circuit 36, if necessary, to light-control (dim) the LED lamp 14.

As described above, in the second embodiment, the attachment detecting portion 37 of the dedicated power source 15 is constituted so that the LED element 25 and detection resistor 26 of the LED lamp 14 are connected in parallel to the second voltage dividing resistor 62. Thus, when the LED lamp 14 is not connected between the connection pins 57, 57, voltage division is performed only by the voltage dividing resistors 61 and 62, and when the LED lamp 14 is connected between the connection pins 57, 57, voltage division is performed by parallel connection resistances between the first voltage dividing resistor 61 and the second voltage dividing resistor 62 with the detection resistor 26 and thus the DC voltage level $V_{CS}$ is lowered. Accordingly, by comparing the DC voltage level $V_{CS}$ obtained by dividing a DC constant voltage from the constant voltage source 63 by the second voltage dividing resistor 62 with a predetermined threshold voltage $V_{th}$ to detect attachment of the LED lamp 14, attachment of the LED lamp 14 can be reliably detected.

According to the above-described embodiments, attachment of the LED lamp 14 can be reliably detected based on the voltage level (DC voltage level $V_{CS}$) changing in accordance with attachment/detachment of the detection resistor 26 by attachment/detachment of the LED lamp 14.

Moreover, in each of the above-described embodiments, for example, three or more voltage dividing resistors may be arranged which are electrically connected in series to each other. So long as the voltage level changes in accordance with attachment/detachment of the detection resistor 26 by attachment/detachment of the LED lamp 14, the attachment detecting portion 37 can be arbitrarily constituted.

As the LED lamp 14, not only a straight-tube type LED lamp but also a ring-shaped LED lamp, a self-ballasted LED lamp, etc., are usable.

As the lighting circuit 36, a so-called low side switching type circuit is employable in which the lighting switching element 41 is connected to a low potential side (low side) of the DC power source portion 35 and performs switching.

In the LED lamp 14, the detection resistor 26 may be arranged at a downstream side (low potential side) of the rectifying element 27.

A plural light type lighting fixture using the plurality of sets of the pair of sockets 13 may be used. The LED lamp system 11 is applicable not only to a ceiling direct mounting type lighting fixture but also to an embedding type lighting fixture, etc.

Power may be supplied to the LED lamp 14 via both pair of sockets 13 or only one of them. When power is supplied via only one of the sockets 13, the other socket 13 may only support an end of the LED lamp 14. Alternatively, for example, a dimming signal may be transmitted to the lamp 14 via the other socket 13 so that the lit LED element 25 is dimmed by a dimming circuit built in the LED lamp 14. Additionally, without use of the socket 13, power may be supplied from a non-contact power supplying portion arranged at the fixture body 12 side to a non-contact power receiving portion arranged at the LED lamp 14 side by a dielectric coupling method or the like. Additionally it is allowed that the sockets 13 are used only for supporting the LED lamp 14 and another power supplying method may be used for the LED lamp 14.

What is claimed is:

1. An LED lamp system comprising:
an LED lamp including:
an LED element, and
a detection resistor connected in parallel to the LED element, a resistance value of the detection resistor being not less than four and not more than six times a load impedance of the LED element at a dimming lower limit; and
a power source unit for the LED lamp including:
a DC power source portion,
a lighting circuit which receives power supplied from the DC power source portion and light-controls the LED lamp, and
an attachment detecting portion for detecting attachment of the LED lamp based on a voltage level changing in accordance with attachment/detachment of the detection resistor by attachment/detachment of the LED lamp.

2. The LED lamp system according to claim 1, wherein the attachment detecting portion includes a plurality of voltage dividing resistors connected in parallel to at least either the LED element or detection resistor of the LED lamp, compares a voltage division level of at least any of the voltage dividing resistors with a predetermined threshold voltage, and detects attachment of the LED lamp by the comparing of the voltage division level with the predetermined threshold voltage.

3. The LED lamp system according to claim 1, wherein the attachment detecting portion can vary a threshold voltage in accordance with an input voltage of the power supplied from the DC power source portion to the lighting circuit.

4. The LED lamp system according to claim 1, wherein the LED lamp has a same tube length and tube diameter as those of a straight-tube type fluorescent lamp.

5. An LED lamp system comprising:
an LED lamp including:
an LED element which has a rated current value of 350 mA in a full-lighting state and a dimming lower limit of 0.5% of the full-lighting state, and
a detection resistor connected in parallel to the LED element, a resistance value of the detection resistor being not less than 270 and not more than 330 kΩ and
a power source unit for the LED lamp including:
a DC power source portion,
a lighting circuit which receives power supplied from the DC power source portion and light-controls the LED lamp, and
an attachment detecting portion for detecting attachment of the LED lamp based on a voltage level changing in accordance with attachment/detachment of the detection resistor by attachment/detachment of the LED lamp.

6. The LED lamp system according to claim 5, wherein the attachment detecting portion includes a plurality of voltage dividing resistors connected in parallel to at least either the LED element or detection resistor of the LED lamp, compares a voltage division level of at least any of the voltage dividing resistors with a predetermined threshold voltage, and detects attachment of the LED lamp by the comparing of the voltage division level with the predetermined threshold voltage.

7. The LED lamp system according to claim 5, wherein the attachment detecting portion can vary a threshold voltage in accordance with an input voltage of the power supplied from the DC power source portion to the lighting circuit.

8. The LED lamp system according to claim 5, wherein the LED lamp has a same tube length and tube diameter as those of a straight-tube type fluorescent lamp.

9. An LED lamp system comprising:
an LED lamp including:
an LED element which has a rated current value of 350 mA in a full-lighting state and a dimming lower limit of 0.5% of the full-lighting state, and
a detection resistor connected in parallel to the LED element, a resistance value of the detection resistor being not less than 130 and not more than 170 kΩ and
a power source unit for the LED lamp including:
a DC power source portion,
a lighting circuit which receives power supplied from the DC power source portion and light-controls the LED lamp, and
an attachment detecting portion for detecting attachment of the LED lamp based on a voltage level changing in accordance with attachment/detachment of the detection resistor by attachment/detachment of the LED lamp.

10. The LED lamp system according to claim 9, wherein the attachment detecting portion includes a plurality of voltage dividing resistors connected in parallel to at least either the LED element or detection resistor of the LED lamp, compares a voltage division level of at least any of the voltage dividing resistors with a predetermined threshold voltage, and detects attachment of the LED lamp by the comparing of the voltage division level with the predetermined threshold voltage.

11. The LED lamp system according to claim 9, wherein the attachment detecting portion can vary a threshold voltage in accordance with an input voltage of the power supplied from the DC power source portion to the lighting circuit.

12. The LED lamp system according to claim 9, wherein the LED lamp has a same tube length and tube diameter as those of a straight-tube type fluorescent lamp.

* * * * *

UNITED STATES PATENT AND TRADEMARK OFFICE

CERTIFICATE OF CORRECTION

PATENT NO. : 9,066,407 B2
APPLICATION NO. : 13/188571
DATED : June 23, 2015
INVENTOR(S) : Hiroshi Terasaka It is certified that error appears in the above-identified patent and that said Letters Patent is hereby corrected as shown below:

TITLE PAGE,

Item [73], Assignees, replace "Toshiba Lighting & Technology Corporation, Kanagawa (JP); Panasonic Corporation, Osaka (JP); Panasonic Electric Works Co., Ltd., Osaka (JP)" with --Toshiba Lighting & Technology Corporation, Kanagawa (JP); Panasonic Corporation, Osaka (JP)--

Signed and Sealed this
Seventh Day of June, 2016

Michelle K. Lee

Michelle K. Lee
*Director of the United States Patent and Trademark Office*